US006763541B2

(12) United States Patent
Mahoney et al.

(10) Patent No.: US 6,763,541 B2
(45) Date of Patent: Jul. 20, 2004

(54) INTERACTIVE AIR BED

(75) Inventors: Paul J. Mahoney, Stillwater, MN (US); Peter S. Bils, Edina, MN (US); Troy C. Lanz, Sr., Brooklyn Park, MN (US); Robert Ostman, Woodbury, MN (US)

(73) Assignee: Select Comfort Corporation, Minneapolis, MN (US)

( * ) Notice: Subject to any disclaimer, the term of this patent is extended or adjusted under 35 U.S.C. 154(b) by 0 days.

(21) Appl. No.: 10/165,108

(22) Filed: Jun. 7, 2002

(65) Prior Publication Data

US 2002/0184711 A1 Dec. 12, 2002

Related U.S. Application Data

(60) Provisional application No. 60/296,668, filed on Jun. 7, 2001.

(51) Int. Cl.[7] ..... A47C 27/10
(52) U.S. Cl. ..... 5/713; 5/655.3; 5/904
(58) Field of Search ..... 5/713, 655.3, 904, 5/940, 710, 644, 944

(56) References Cited

U.S. PATENT DOCUMENTS 3,938,120 A 2/1976 O'Connell
4,554,419 A 11/1985 King et al.
4,711,275 A * 12/1987 Ford et al. ..... 141/95
4,972,533 A 11/1990 Brown
4,984,098 A 1/1991 Buntsis
5,003,654 A 4/1991 Vrzalik
5,485,139 A 1/1996 Tarnovsky
5,699,038 A * 12/1997 Ulrich et al. ..... 340/286.07
5,793,281 A 8/1998 Long
5,923,252 A 7/1999 Sizer et al.
6,223,363 B1 5/2001 Sumlin
6,483,264 B1 * 11/2002 Shafer et al. ..... 318/16
2002/0144345 A1 * 10/2002 Lane ..... 5/424

* cited by examiner

*Primary Examiner*—Teri Pham Luu
*Assistant Examiner*—Fred Conley
(74) *Attorney, Agent, or Firm*—Oppenheimer Wolff & Donnelly LLP; David J. McKinley

(57) ABSTRACT

An air bed having a pump and a relief valve is operably connected with a control box. The control box is capable of being programmed or receiving scripted information from a media file such that timed pressure changes may be made in the air bed by operation of the pump and the relief valve. These changes are synchronized with a message being played by a media player. Thus the air bed interacts with a person lying on the bed. This interaction is used, preferably in a sales setting, to convey information to the person about the operation and features of the air bed.

24 Claims, 3 Drawing Sheets

INTERACTIVE AIR BED

This application claims the benefit of Provisional Application No. 60/296,668 filed Jun. 7, 2001.

BACKGROUND OF THE INVENTION

Advances made in quality beds having air mattresses as support bases have resulted in vastly increased popularity and sales of such air beds. These air beds are advantageous in that they typically have an electronic control panel which allows a user to select a desired inflation setting for optimal comfort and change the inflation setting at anytime, thereby providing changes in the firmness of the bed, resulting in different sensations. This feature alone makes them slightly more complicated than standard spring mattresses which are relatively static.

The increased complexity of air beds relative to standard spring mattresses is most evident in a sales environment such as a mattress store. An average consumer at a spring mattress store can usually wander from mattress to mattress, analyzing those of interest by simply lying on the mattresses and comparing the level of comfort between them. If a customer has a question about a mattress, a sales clerk is usually available.

However, the operation of an air bed tends to generate more questions and lends itself to increased sales efforts in order to sell a relatively new concept to the average consumer accustomed to sleeping on a spring mattress. Increasing sales staff accordingly, however, is an expensive endeavor and is usually only beneficial during peak sales times. Moreover, consumers may not enjoy having salespeople standing over them while they are in the seemingly vulnerable prone position. It is unnatural to negotiate a sale while lying down.

Traditional solutions to communicating information to a consumer, such as posted signs and printed brochures, are not only difficult to read while lying down, they do not provide the level of interaction necessary to describe the dynamic experience of lying on an air bed while it inflates and deflates. Additionally, these materials require too much effort on the part of the consumer who should be in a complete state of relaxation while sampling an air bed.

Accordingly, there is a need for an interactive selling method and device particularly adapted for use in selling air beds.

More specifically, there is a need for a device that allows a consumer to achieve a relaxed, passive state while receiving a sales message and explanation as to what an air bed is doing to assist the consumer in achieving this relaxed state.

There is a particular need for an interactive selling method and device that obviates the need for a sales person to assist in delivering the sales information.

There is a further need for an air bed that has communications media which is versatile and suitable for home applications as well as store applications.

BRIEF SUMMARY OF THE INVENTION

The present invention pertains generally to an air bed that has integrated audio and/or visual equipment electronically coordinated with the pressure control for the air bed. The audio message may be an informational sales presentation, music, alarm tone, therapeutic sleeping aid, or the like.

The air bed generally comprises a bladder pneumatically connected to an electric pump. The bladder is surrounded by a soft border and encased by quality mattress ticking. The electric pump includes a manual remote control (tethered or wireless) which allows a user to inflate or deflate the bladder while lying on the bed. The manual remote electronically communicates with a circuit board controlling the pump and monitoring the pressure in the bladder. A compact disc or other audio device is operably connected to the pump and a speaker such that when a start command is received, either by the pressing of a button, a proximity sensor, or a significant increase in bladder pressure, the audio device begins to play a message. A control box or switch box with a programmable timing circuit operates the pump and associated relief valves such that the air pressure in the bladder changes in coordination with the message being played.

The message played by the speakers explains to potential buyers what they are experiencing as they are lying on the bed in the store. While the manual remote control allows a user to select a desired pressure level, preferably, the switch box controls when the manual remote may be operated by the potential buyer. This allows a presentation to be given without interruption until a predetermined time in the program when the potential buyer is instructed to begin experimenting with the manual control.

For example, the bed may be preset at the firmest setting. When a start command is received, the bed starts a recording which provides a demonstration to the user. The bed begins to deflate while the voice explains to the potential buyer what they are experiencing and how they should best determine what their optimal pressure setting might be. The prerecorded voice could additionally have any number of slogan or sale points that the manufacture may want to communicate to a potential buyer. Such a bed conveys desired information to a consumer without the additional sales pressure often delivered by a salesperson. Store overhead is also lowered as a smaller sales force becomes adequate.

Another embodiment includes a video or audio/visual device similarly associated with the pump. For example, a television display above the bed may provide a video further explaining the experience and providing additional information pertaining to the construction and operation of the bed. This visual message would also be coordinated with the action of the pump.

Though optimally suited for a sales environment, it is envisioned that the various embodiments of the present invention have many other applications. For example, the air bed, combined with the audio and or visual media, could be advantageous as a sleeping aid. A soothing message coordinated with the pleasurable, sinking feeling one gets as the bed deflates, could assist in relaxing a user to the point of slumber. Conversely, a clock is envisioned which, when used as an alarm, plays a desired sound or song to wake a sleeper. The bed could re-inflate to a firmest setting to encourage the occupant to get out of the bed.

Another embodiment provides a bed which plays audio stories, such as children's stories, and is accompanied by changes in pressure to either assist in inducing sleep or add another dimension to the story. As children are often resistant to going to bed, an interactive story system may present an attraction to getting into bed.

Another embodiment provides a bed with a preprogrammed, possibly personalized, relaxation and stress management program. This system may have various settings depending on whether it is desired that the user sleep for the night following the relaxation session. For example, if it is desired to undergo a twenty minute anger or stress management therapy session, and then return to normal daily activities, the program may be more interactive, delivering a message and requiring responses from the user to ensure the user stays awake during the session.

Another embodiment utilizes rapid or rhythmic pressure changes to assist in treating both stress-related problems, such as tension, as well as medical conditions, such as fibromyalgia. Audio messages are preferably timed with the massage therapy to instruct the user to turn over, raise and lower arms, etc.

Yet another embodiment provides a stretching program similarly coordinated with pressure changes which instructs a user to engage in various stretching exercises. This embodiment might be particularly useful for users with lower back pain or more serious back injuries.

Still another embodiment provides a bed with a programmable message such that parents may record messages to be played to their young children during periods of absence such as when a babysitter is hired. Young children may find their parents' voices and lullabies soothing and relaxing.

One embodiment provides a programmable timer which allows a user to program a predetermined schedule of pressure changes throughout the night. Many people enjoy a softer surface while falling asleep and a firmer surface once sleep has been achieved. Audio and/or video stimulation, such as an alarm clock, may be incorporated into the schedule.

Yet another embodiment provides an air bed with speakers near the head of the user. An audio input jack allows output from a device such as a television to be transmitted through the speakers. Such a device would provide a way of watching television at night without waking people sleeping in adjacent rooms.

DETAILED DESCRIPTION OF THE INVENTION

Figure 1:
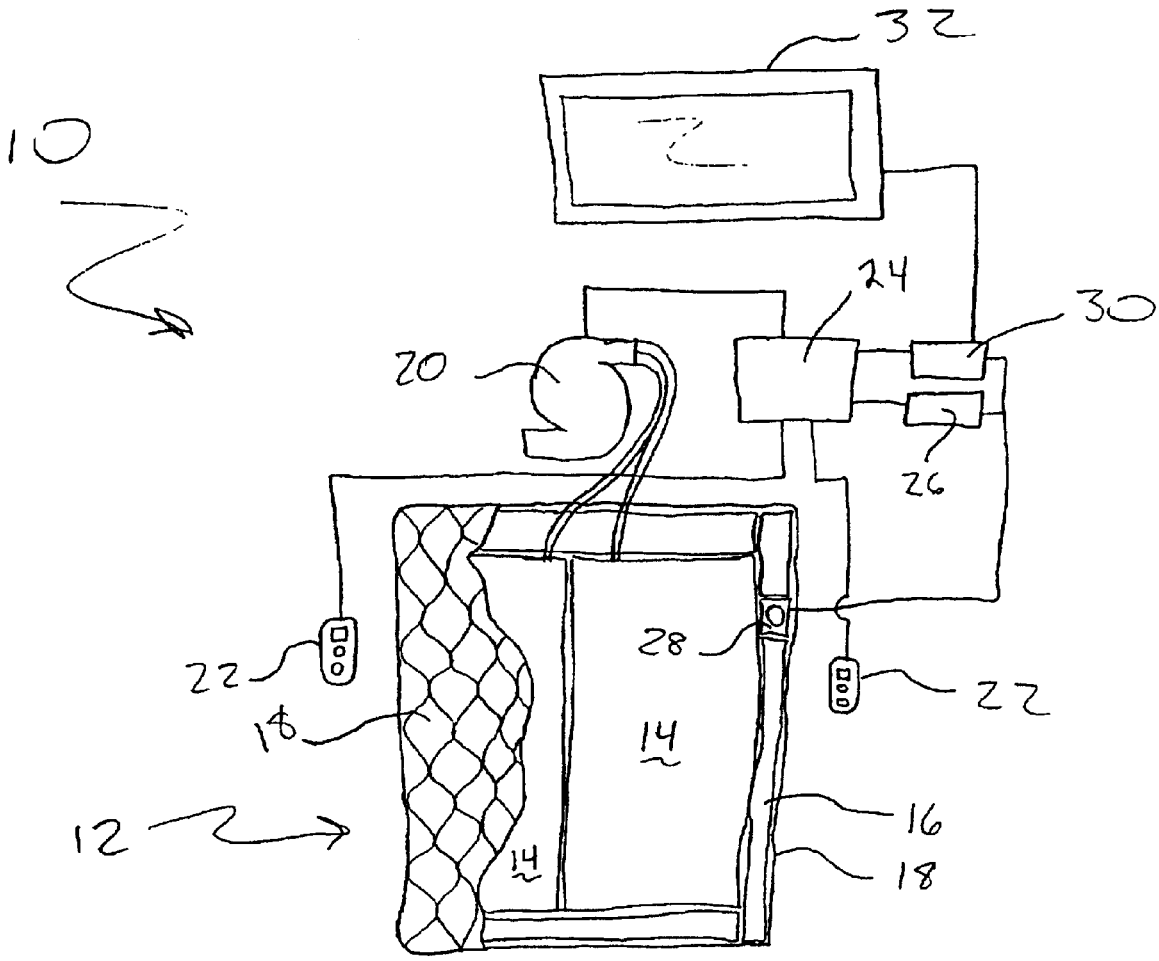
FIG. 1 is a diagrammatic representation of the bed of the present invention.

Referring now to the Figures, and first to FIG. 1, there is shown a diagrammatic representation of the device 10 of the present invention. The device 10 includes a bed 12, which generally comprises at least one air bladder 14 surrounded by a resilient, preferably foam, border 16 and encapsulated by bed ticking 18.

The bladders 14 are in fluid communication with a pump 20. In the event there are more than one bladder 14, it may be desired to provide a separate pump 20 for each bladder 14 or to provide one pump 20 connected to all of the bladders 14.

The pump 20 is in electrical communication with manual remote controls 22 via a control box 24. The control box 24 is operating the pump 20 to cause increases and decreases in the fluid pressure of the bladder 14 at programmed times. The control box 24 is also in electrical communication with an audio device 26. The audio device 26 is capable of playing a desired message through a speaker 28. The audio device 26 may be any device capable of reading magnetic media, laser readable data, digital information, or the like. A preferred embodiment provides a recording capability. The speaker 28 is shown as being housed by the bed 12 in an interruption in the border 16. Alternatively, the speaker 28 could be mounted externally.

A preferred embodiment further comprises a video media playing device 30 operably attached to a video screen 32. The video media playing device 30 is also in electrical communication with the control box 24 such that any video presentation played on the screen 32 can be coordinated with pressure changes in the bladders 14. The screen 32 may include its own internal speakers or the playing device 30 may be operably connected with the speaker 28. The video media playing device 30 may also be the same device as the audio device 26, such as a digital video disc (DVD) player.

Figure 2:
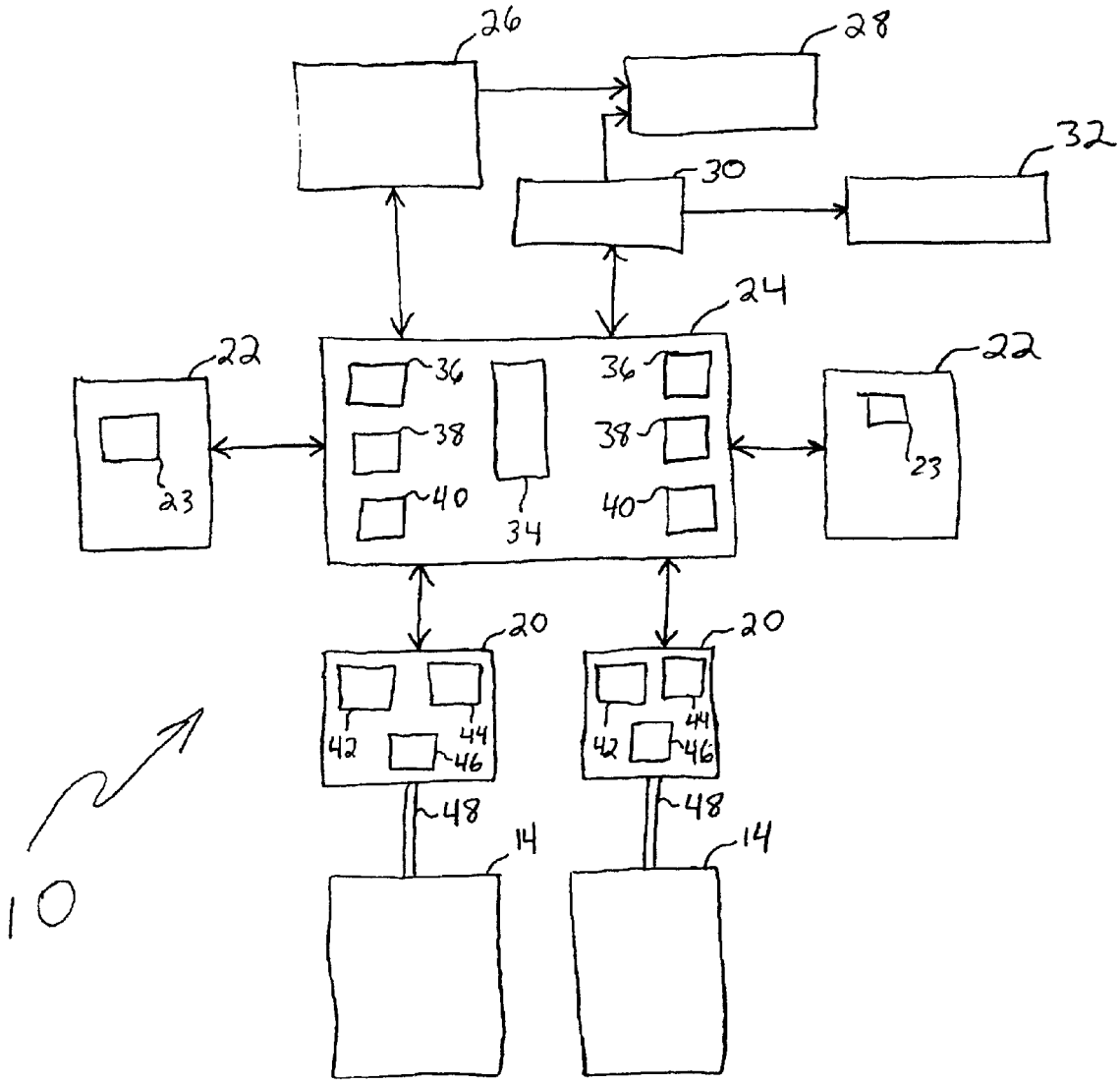
FIG. 2 is a block diagram of the various components of the bed of the present invention.

FIG. 2 shows a preferred block diagram detailing the data communication between the various components of the present invention 10. Beginning with the control box 24, it can be seen that the control box 24 comprises a power supply 34, at least one microprocessor 36, at least one relay 38, and at least one analog to digital (A/D) converter 40.

The pumps 20 are preferably in two-way communication with the control box 24. The pumps 20 each include a motor 42, a relief valve 44, and a pressure transducer 46. The pump 20 is fluidly connected with the bladder 14 with a tube 48.

Also in two-way communication with the control box 24, are the hand-held remote controls 22, the audio player 26 and/or the video player 30. Two-way communication between the control box 24 and the players 24 and 30 are only necessary if the media played by these players 24 and 30 are to include command files.

The audio player 26 is in one-way data flow with at least one speaker 28. The video player 30 is in one-way data flow communication with a monitor 32 and preferably at least one speaker 28, as well.

In operation, the power supply 34 receives power, preferably 110 VAC power, from an external source and converts it to the various forms necessary by the different components. It is envisioned that some of the audio/visual components may have separate power supplies.

The microprocessors 36 are used to control the various logic sequences of the present invention 10. One example of such a sequence is detailed in FIG. 3 and Appendix A and discussed in more detail below. The preferred embodiment shown in FIG. 2 contemplates two bladders 14, two pumps 20 and two microprocessors 36, but it is envisioned that, in the case of a bed with two bladders 14, some or all of the other components may be replaced by a single component to minimize costs.

In the event that the microprocessors 36 send a decrease pressure command, the relays 38 are used to convert the low voltage command signals sent by the microprocessors 36 to higher operating voltages sufficient to operate the relief valves 44 of the pumps 20. Alternatively, these relays could be located within the pumps 20.

Opening the relief valves 44 allows air to escape from the bladders 14 through the air tubes 48. During deflation, the pressure transducers 46 are sending pressure readings to the microprocessors 36 via the A/D converters 40. The A/D converters 40 receive analog information from pressure transducers 46 and convert that information to digital information useable by the microprocessors 36.

In the event that the microprocessors 36 send an increase pressure command, the pump motors 42 are energized, sending air to the bladders 14 through the air tubes 48. Again, the pressure transducers 46 are sending pressure readings to the microprocessors 36 via the A/D converters 40.

The microprocessors 36 use the information received from the converters 40 to determine the difference between the actual pressure in the bladder 14 and the desired pressure. The microprocessors 36 send the digital signal on to the hand controls 22 to update displays 23 on the controls 22 that convey the pressure information to the users.

The desired pressure information comes from various sources, depending on what mode the interactive air bed 10 is in. In a sales environment, or when the interactive feature is being used, the bed is in an interactive mode. In the interactive mode, desired pressure is determined based on a script being played. The script, such as the one shown in FIG. 3 and Appendix A, may be synchronized with timing circuits within the microprocessors 36 such that a message being played over the audio player 26 and/or the video player 30 is synchronized with the actions of the pumps 20. Alternatively, digital media being played by the players 26 and/or 30, may include digital command signals, readable by the microprocessors 36, that tell the microprocessors 36 how and when to operate the pumps 20.

A manual mode is available whereby the desired pressure is received from the hand controls 22. It is envisioned that even during the interactive mode, the script being played may call for intervals of manual mode operation such that a user, such as a prospective buyer, may be given an opportunity to adjust the pressure in the bed.

Figure 3:
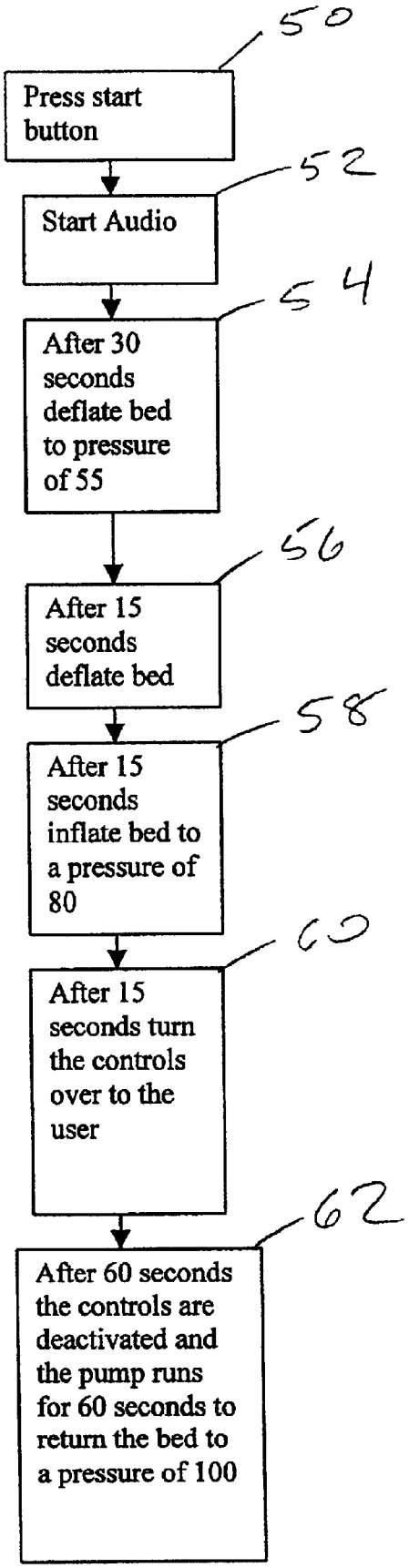
FIG. 3 is a flowchart of a pump logic sequence of the present invention

FIG. 3 shows a flowchart of a sample pump logic sequence of the present invention. The sequence begins at 50 when a start button is pressed or a significant increase in pressure is detected in the bladder. A start button may be provided on the manual remote control 22. Preferably, after sitting idle for a predetermine period, the logic sequence enters a sleep mode, whereby pressing any of the buttons on the manual remote control 22 "awakens" the system 10 and initiates the sequence at 50.

Next, a timer is reset and starts timing the duration of the sequence while the audio or audio/visual message begins at 52. At 54, it can be seen that the message plays for 30 seconds and the bladder begins to deflate to a predetermined pressure setting. At 56 an additional 15 seconds has elapsed and the bed begins to deflate to a second predetermined pressure setting which is lower than the setting at 54. Another 15 seconds is allowed to elapse at 58 and the pump motor is energized and the bladder 14 is inflated to a higher predetermined pressure setting. All the while an audio message is explaining what is happening to a potential buyer.

At 60 the control box 24 begins to accept electronic signals from the remote control 22 and the user is instructed to experiment with the control 22 to determine a most comfortable pressure setting. This continues for 60 seconds until, at 62, the controls 22 are deactivated and the pump runs for another 60 seconds to reinflate the bladder to the highest pressure setting and await the next demonstration.

This is only an example of a message sequence. The control box 24 is completely programmable and can be used to create any number of such sequences. Preferably, the audio device 26 and/or the video device 30, is capable of playing media that not only include audio and video information that is sent to the speakers, but also include data files that send commands to the control box 24 pertaining to the inflation and deflation of the bladders 14. For example, in a preferred embodiment, the control box 24 receives its cues from commands embedded within the media being played by the audio device 26 and/or the video device 30. In this embodiment, the timer may be unnecessary.

The following is an example of an audio script to be played over the speakers 28 during the sequence of FIG. 3.

Example Script

Welcome, I'm the revolutionary, sleep number 3000 bed by Select Comfort. I'll change forever how you think about mattresses and sleep! For the next couple of minutes my remotes will remain inactive while you learn why nearly two million people are getting their best nights sleep ever!

Currently, each independent side of me is set at a sleep number of 100 which represents my firmest setting. Let's try a softer sleep number of 55. Running Time=29.26

DROP Running Time at end of drop=44.3

Now you're beginning to feel what makes me so special!

You'll notice how I'm contouring perfectly to your body, reducing pressure points. Have you ever woken up with your arm asleep or tingling? That was caused by those uncomfortable, sometimes painful areas of high pressure created by overly firm innerspring mattresses.

So what exactly is a sleep number? A sleep number is the key to the best nights sleep ever! It is a number between 0 & 100 that represents the ideal combination of comfort, firmness and support for your body! To further experience the range of sleep numbers, lets try a softer sleep number of 30. Running Time to here 87.48

DROP TO 30 PAUSE 5 SECONDS. Now I'm really starting to cradle every inch of you in luxurious comfort, yet I'm still providing total body support! It's a great feeling to lie down at the end of an exhausting day and feel the stress melt away in your sleep number bed! Soon I'll reach a sleep number of 30, one of our most popular sleep numbers; but if you prefer a firmer bed, hold on, that's next! PAUSE Running Time after drop=117.54

No matter what your sleep number is, once you've found it, you'll fall asleep faster, sleep more deeply and awake feeling better rested than every before! As clinically proven in studies conducted at Stanford and Duke Universities. Brief Pause I think you'll agree, the ability to change my sleep number at any time to any sleep number between 0 and 100 on each side independently is part of what makes me so unique! Wouldn't it be great to enjoy the comfort and support of a Sleep Number bed every night?! And with a 20 year warranty, it may be the last bed you'll every need!

Now lets have some real fun! I'm going to firm things up a bit. I want you to pay close attention to your lower back. Running Time=165.36

RAISE TO 80. Running Time after drop=198.44

Now I'm at a sleep number of 80, pretty firm huh? Does it surprise you to know that I am actually softer now than when we started? We started at a sleep number of 100! For most people, firmer is not better, it's all about personal comfort and support! PAUSE Now it's your turn to make adjustments, so for the next 60 seconds, I'll turn the controls over to you. To make adjustments simply press the firmer or softer buttons and release when you're comfortable. REMOTE IS NOW ACTIVE Did you know that over 80 million Americans will experience back pain in their lifetime? PAUSE It's a good thing that 93% of back pain sufferers participating in a clinical study reported back pain relief on a sleep number bed! 93% is an impressive number, in fact you may not have believed it if you hadn't experienced this comfort and support for yourself!

Here's another interesting fact. 9 out of 10 couples disagree on the firmness level of their mattress. With a sleep number bed, two people never have to compromise again! PAUSE A 20 year warranty, no flipping, no rotating, adjustable firmness for each person, and sleep number technology all for about 20 cents a night! Add it all up and I know you'll agree, the sleep number bed is an outstanding value!

This concludes your sleep number experience, in a few seconds, I'll automatically adjust the sleep number back to 100. To find your personal sleep number, visit the Sleep number 3000 bed or see your sales professional for details on how you can begin sleeping better on a Sleep Number Bed! Total Time equals 310.95 seconds It is contemplated that features disclosed in this application can be mixed and matched to suit particular circumstances. Various other modifications and changes will be apparent to those of ordinary skill in the art without departing from the spirit and scope of the present invention. Accordingly, reference should be made to the claims to determine the scope of the present invention.

What is claimed is:

1. An interactive air bed comprising:

an inflatable bladder;

a fluid pump in fluid communication with the bladder;

a relief valve in fluid communication with the bladder;

a control box, operably connected to the fluid pump, the control box having:

at least one microprocessor;

a power supply;

a pressure transducer in fluid communication with the bladder;

a relay operably connected to the pressure relief valve;

a manual remote control operably connected with the control box;

an audio player operably connected to the control box;

at least one speaker operably connected to the audio player.

2. The air bed of claim 1 further comprising a video player operably connected to the control box.

3. The air bed of claim 2 wherein the video player and the audio player comprise a single audio/video device.

4. The air bed of claim 3 wherein the audio/video device comprises a digital video disc player.

5. The air bed of claim 1 wherein said speaker is operably disposed within a foam border surrounding the bladder.

6. The air bed of claim 1 wherein the manual remote control comprises a wireless manual remote control.

7. The air bed of claim 1 wherein the manual remote control comprises a tethered remote control.

8. The air bed of claim 1 further comprising:

a second inflatable bladder in fluid communication with the fluid pump;

a second manual remote control operably connected with the control box for use in adjusting a fluid pressure in the second inflatable bladder; and, wherein the control box further has a second pressure transducer in fluid communication with the second bladder.

9. The air bed of claim 1 further comprising:

a second inflatable bladder;

a second fluid pump in fluid communication with the second bladder and operably connected to the control box;

a second manual remote control operably connected with the control box for use in adjusting a fluid pressure in the second inflatable bladder; and, wherein the control box further has a second pressure transducer in fluid communication with the second bladder.

10. The air bed of claim 1 further comprising at least one data file read by the microprocessor, commanding the control box to change a fluid pressure in the bladder.

11. The air bed of claim 10 wherein said data file is stored in media played by said audio player.

12. The air bed of claim 10 wherein said data file is stored in media played by a video player operably connected to the control box.

13. The air bed of claim 10 further comprising local memory and wherein said data file is stored thereon.

14. A method of communicating a message to a person laying on an air bed comprising:

providing an audio player operably connected to a control box of the air bed;

playing the message with the audio player upon sensing that the person is laying on the air bed;

synchronizing the message with changes in fluid pressure in the air bed.

15. The method of claim 14 wherein sensing that the person is laying on the air bed comprises detecting a sudden change in fluid pressure in the air bed due to the weight of the person.

16. The method of claim 14 wherein sensing that the person is laying on the air bed comprises receiving a signal from a manual hand held remote control operably connected to the control box.

17. The method of claim 14 wherein synchronizing the message with changes in the fluid pressure in the air bed comprises providing media, played by the audio player, that includes at least one data file read by the control box.

18. An interactive air bed comprising:

an inflatable bladder;

an first means for increasing a fluid pressure inside of said bladder;

a second means for decreasing said fluid pressure inside of said bladder;

a third means for controlling said first means and said second means;

a fourth means for communicating a message to a person lying on said mattress, said fourth means operably connected to said third means such that said third means is capable of operating said first means and said second means in correspondence with said message.

19. The interactive air bed of claim 18 wherein said first means comprises a fluid pump in fluid communication with said bladder.

20. The interactive air bed of claim 19 wherein said second means comprises a relief valve in fluid communication with said bladder.

21. The interactive air bed of claim 19 wherein said third means comprises a control box having:

at least one microprocessor;

a power supply;

a pressure transducer in fluid communication with the bladder; and, a relay operably connected to the second means.

22. The interactive air bed of claim 19 wherein said fourth means comprises an audio player.

23. The interactive air bed of claim 19 wherein said fourth means comprises a digital video disc player operably connected to a video display and at least one speaker.

24. The interactive air bed of claim 19 wherein said third means comprises a microprocessor and memory and said fourth means comprises a data file stored in said memory and at least one speaker operably attached to said microprocessor.

* * * * *